US008465327B2

(12) United States Patent
Springer et al.

(10) Patent No.: US 8,465,327 B2
(45) Date of Patent: Jun. 18, 2013

(54) HIGH-SPEED MEMORY CONNECTOR

(75) Inventors: Greg Springer, Sunnyvale, CA (US); Vince Duperron, Cupertino, CA (US); Marc Simmel, Cupertino, CA (US); Peter Mitchell, Los Gatos, CA (US); Joshua Funamura, San Jose, CA (US)

(73) Assignee: Apple Inc., Cupertino, CA (US)

( * ) Notice: Subject to any disclaimer, the term of this patent is extended or adjusted under 35 U.S.C. 154(b) by 142 days.

(21) Appl. No.: 12/905,692

(22) Filed: Oct. 15, 2010

(65) Prior Publication Data

US 2011/0250768 A1 Oct. 13, 2011

Related U.S. Application Data

(60) Provisional application No. 61/257,431, filed on Nov. 2, 2009.

(51) Int. Cl.
*H01R 24/00* (2011.01)

(52) U.S. Cl.
USPC ..... 439/637; 439/631

(58) Field of Classification Search
USPC ..... 439/77, 59, 67, 493, 631, 636, 637
See application file for complete search history.

(56) References Cited

U.S. PATENT DOCUMENTS

| | | | | |
|---|---|---|---|---|
| 4,865,562 | A * | 9/1989 | Burg et al. | 439/395 |
| 7,766,680 | B2 * | 8/2010 | Suzuki et al. | 439/260 |
| 2006/0050496 | A1 * | 3/2006 | Goodwin | 361/803 |
| 2008/0072422 | A1 * | 3/2008 | Levante et al. | 29/852 |

* cited by examiner

*Primary Examiner* — Neil Abrams
*Assistant Examiner* — Travis Chambers
(74) *Attorney, Agent, or Firm* — Kilpatrick Townsend & Stockton LLP

(57) ABSTRACT

Structures, methods, and apparatus that provide sockets or connectors that are capable of operating at high data rates. One example provides a connector that uses a flex board to form a connection between pins of a socket or connector and a printed circuit board. In another example, one or more flex boards are used to provide a signal path between a memory device, such as an SODIMM, and a printed circuit board. Another example provides a stack of wafers, each formed of an insulated material and supporting one or more conductive pins for making an electrical connection between a memory device and a flex board.

16 Claims, 22 Drawing Sheets

HIGH-SPEED MEMORY CONNECTOR

CROSS-REFERENCES TO RELATED APPLICATIONS

This application claims the benefit of U.S. provisional application No. 61/257,431, filed Nov. 2, 2009, entitled "High-Speed Memory Connector," which is incorporated by reference.

BACKGROUND

Memory devices for computer systems have been increasing in size and operating frequency for years, and these increases show no signs of abating.

Computers may use multiple levels of memory. For example, a central processing unit (CPU) may have a limited amount of on-chip cache memory. Additional memory may be included on a motherboard for easy access by the CPU. This additional memory may be random-access memory (RAM.) The RAM may be included on a small-outline dual inline memory module (SODIMM.) Still more memory may be made available in the form of a hard-disk drive.

It may be desirable to be able to replace this additional memory. For example, a user may want to upgrade the memory to a faster or larger memory. Also, a user may want to be able to replace a memory that has become defective. Accordingly, it has become common to use a socket or connector to form an interface between memory devices, such as an SODIMM, and a motherboard. Using a socket or connector allows a user to remove and insert memory devices in a computer system.

It is also desirable to use memory that can operate at a higher data rate. Such memories improve system performance by being more responsive, reducing wait times, providing improved graphical or audio performance, and speeding up background operations. Faster memories are consistently being developed and users want to be able to take advantage of their increased performance.

Unfortunately, the sockets or connectors that are typically used for these memories can degrade signals, create crosstalk between signals, and otherwise reduce performance. They may also generate noise that can degrade the performance of other circuits in a device, such as wireless transceivers, audio, or other types circuits.

Thus, what is needed are structures, methods, and apparatus that provide sockets or connectors that are capable of operating at high data rates with limited crosstalk and interfering emissions.

SUMMARY

Accordingly, embodiments of the present invention provide structures, methods, and apparatus that provide sockets or connectors that are capable of operating at high data rates.

An exemplary embodiment of the present invention may provide a connector that may use a flexible circuit board, or flex board, to form connections between pins of a socket or connector and a printed circuit board, such as a motherboard. The flex board may use microstrips to effectively shield data lines, thereby reducing the amount of electromagnetic interference (EMI) and crosstalk generated. Using a flex board may allow much of a signal path from a device, such as a memory device, to a printed circuit board to be shielded. This reduces the distance that signals travel while they are unshielded, which reduces crosstalk and EMI emissions.

Various embodiments of the present invention may use a flex board having a center ground plane that can be isolated using two isolation layers. Signal lines may be placed on the isolation layers to carry data signals. The signal lines may be protected using further isolation layers. The signal lines may be further electrically isolated by using shield layers, such that the signal lines are between a shield layer and the center ground plane. The shield layers may be tied to ground or other low-impedance point.

In other embodiments of the present invention, the center ground plane may be replaced by a more mechanically stable structure. For example, a center ground plane may be replaced by an insulating layer having a ground layer on each side.

In various embodiments of the present invention, ground and signal layers may be copper or other conductive material. The insulating layers may be polyamide or other insulating materials. In other embodiments of the present invention, other types of boards or signal conduits may be used in place of a flex board. For example, one or more printed circuit boards, ribbon cables, or other conduits may be used. In a specific embodiment of the present invention, an edge of a printed circuit board, such as a motherboard, may be used. In this embodiment, a socket housing is attached to an edge of a printed circuit board that has other associated circuitry attached. Conductive traces terminate in pads near the edge of the printed circuit board. Pins in the socket housing may connect contacts or pads on a memory or other type of device to the pads near the edge of the printed circuit board.

Another specific embodiment of the present invention may provide two sockets for memory devices. A first piece may form a holder for pins for ground and signals. A first flex board may be placed over a portion of the first piece. A second piece having contacts for ground and signals on each side may be located over the first piece and the first flex board. A second flex board may then be placed over the second piece. A third piece having contacts for signals and grounds on one side may be placed over the second piece and the second flex board. After assembly, a first memory device may be inserted between a portion of the first piece and a portion of the second piece, while a second memory device may be inserted between a portion of the second piece and a portion of the third piece.

In this embodiment, the first, second, and third pieces may be plastic or other material. The pins may be copper, aluminum, or other conductive material. A steel frame may be used to provide additional mechanical support for the connectors. In other embodiments of the present invention, sockets may be assembled using more or fewer than three pieces. For example, five pieces may be used to form a socket. In other embodiments of the present invention, a single piece is used to form a socket. In this embodiment of the present invention, flex boards are inserted into a socket housing.

In another embodiment of the present invention, one or more flex boards may be used to provide signal paths directly between a memory device, such as an SODIMM, and a printed circuit board. The flex boards may include contact areas that form a connection with contact areas on a memory device. Tension supplied by a pin or spring may be used to keep the flex board in contact with the memory device. The pin or spring may be plastic, metal, or made from another type of material.

Another exemplary embodiment of the present invention may provide a stack of wafers, each formed of an insulated material and supporting one or more conductive pins for making an electrical connection between a memory device and a flex board. The pins may be arranged such that one, two, or more than two memory devices may be connected to one or more flex boards.

In various embodiments of the present invention, the wafers may include one or more raised portions and holes or openings, such that the wafers may fit together in an aligned manner. The wafers may be housed in a housing to provide mechanical support for the wafer assembly. The pins may make contact with one or more flex boards to a printed circuit board, such as a motherboard. In various embodiments of the present invention, the wafers may be plastic or other nonconductive material. The pins may be formed using copper, aluminum, or other conductive material.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
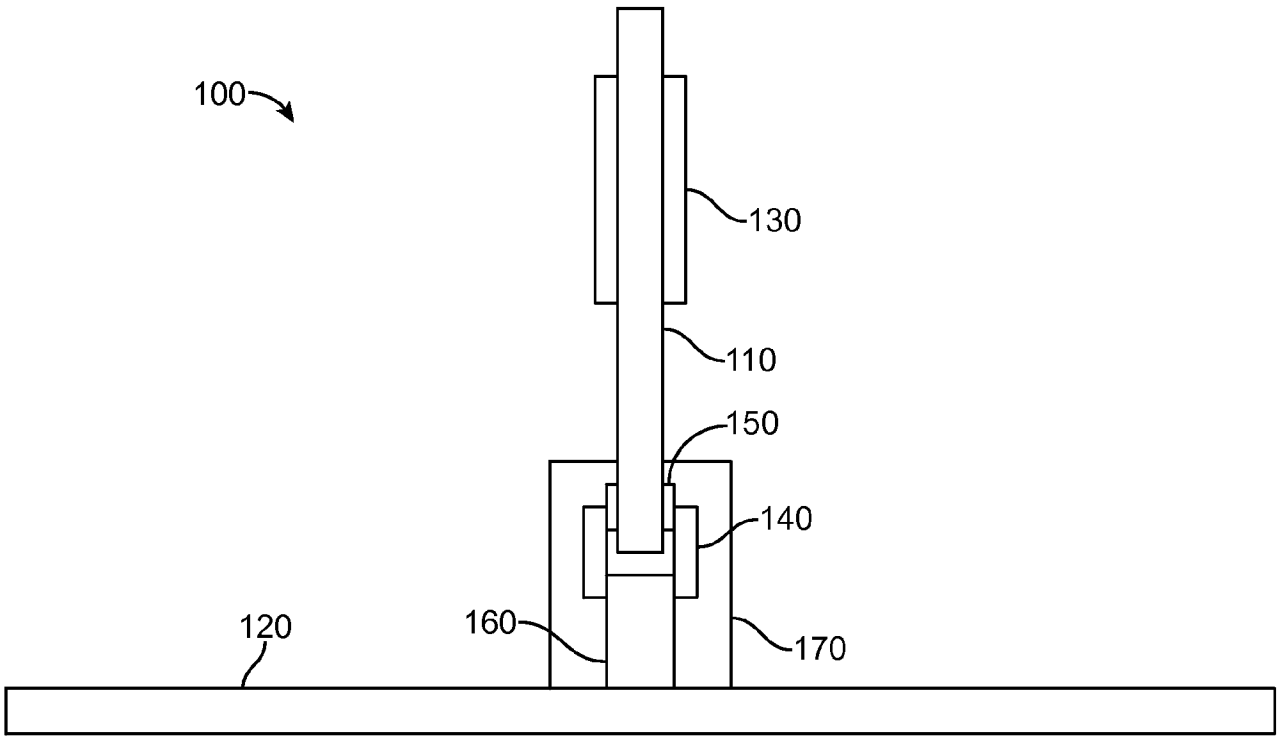
FIG. 1 illustrates a socket or connector according to an embodiment of the present invention.

FIG. 1 illustrates a connector 100 according to an embodiment of the present invention. This figure, as with the other included figures, is shown for illustrative purposes only and does not limit either the possible embodiments of the present invention or the claims.

In this example, connector 100 may connect a memory device 110 to a printed circuit board 120. Memory device 110 may be an SODIMM or other type of memory board, module, or device. Memory device 110 may include a number of memory circuits 130, which may be integrated circuits. Signals generated by circuitry on, or associated with, printed circuit board 120 may be provided to memory device 110 through a conductive path including flex board 160, pins 140, contacts 150, and traces (not shown) on memory device 110. Data from memory devices 130 may be provided to circuitry on, or associated with, printed circuit board 120 via a path including traces (not shown) on memory device 110, contacts 150, pins 140, and flex board 160.

Printed circuit board 120 may be a motherboard or a daughterboard. For example, printed circuit board 120 may be a graphics card, audio card, or other type of board. While a printed circuit board 120 is shown for exemplary purposes, flex board 160 may connect to another type of board, for example, a flex board or other type of board.

Flex board 160 may provide an electrical conduit from pins 140 to printed circuit board 120. Flex board 160 may include microstrips to shield signals transferred between memory device 110 and printed circuit board 120. Connector or socket 100 may be enclosed in a housing 170.

In various embodiments of the present invention, pins 140 may be formed using aluminum, copper, or other metallic or conductive material. Flex board 160 may be formed of a plurality of layers including the metal and insulative layers. Housing 170 may be made of plastic or other nonconductive material. Housing 170 may be mechanically reinforced using a metallic frame or other type of structure.

Again, embodiments of the present invention provide high-speed connectors or sockets. While these connectors or sockets are particularly suited to memory devices, they may be used to hold or connect other types of devices, such as processors, co-processors, or bridges. Various embodiments of the present invention may be used to support operating frequencies of 1.33, 1.66, 1.8, 2.0, or 2.2 GHz, or other operating frequencies. Embodiments of the present invention may provide sockets or connectors for memory devices compatible with DDR3, DDR4, and other memory standards or proprietary methods that have been developed, are currently under development, or will be developed in the future.

In this example, memory device 110 may be roughly orthogonal to printed circuit board 120. In such a configuration, it is relatively easy for a user to extract and insert memory devices 110 from connector 100. In other embodiments of the present invention, it may be desirable that memory device 110 be parallel to printed circuit board 120. This is particularly true in cases where space or clearance is of a concern. An example is shown in the following figure.

Figure 2:
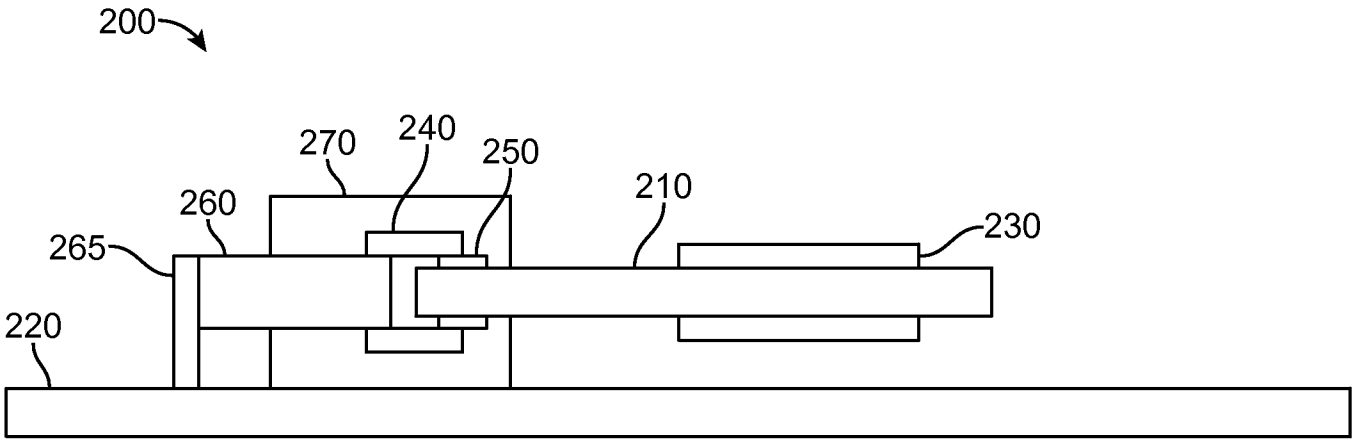
FIG. 2 illustrates a socket or connector according to an embodiment of the present invention.

FIG. 2 illustrates a socket or connector 200 according to an embodiment of the present invention. In this configuration, memory device 210 may be parallel to printed circuit board 220 when it is inserted in connector 200. Again, memory device 210 may include memory circuits 230 and contacts 250. Memory device 210 may be an SODIMM or other type of memory circuit, module, or device. Connector 200 may include pins 240 that make electrical connections between contacts 250 and flex board 260. In this example, additional pins 265 may be used to form connections between flex board 260 and printed circuit board 220. Connector 200 may be enclosed in housing 270.

In various embodiments of the present invention, pins 240 may be formed using aluminum, copper, or other metallic or conductive material. Flex board 260 may be formed of a plurality of layers including metal and insulative layers. Housing 270 may be made using plastic or other nonconductive material. Housing 270 may be mechanically reinforced using a metallic or other type of reinforcing structure.

Figure 3:
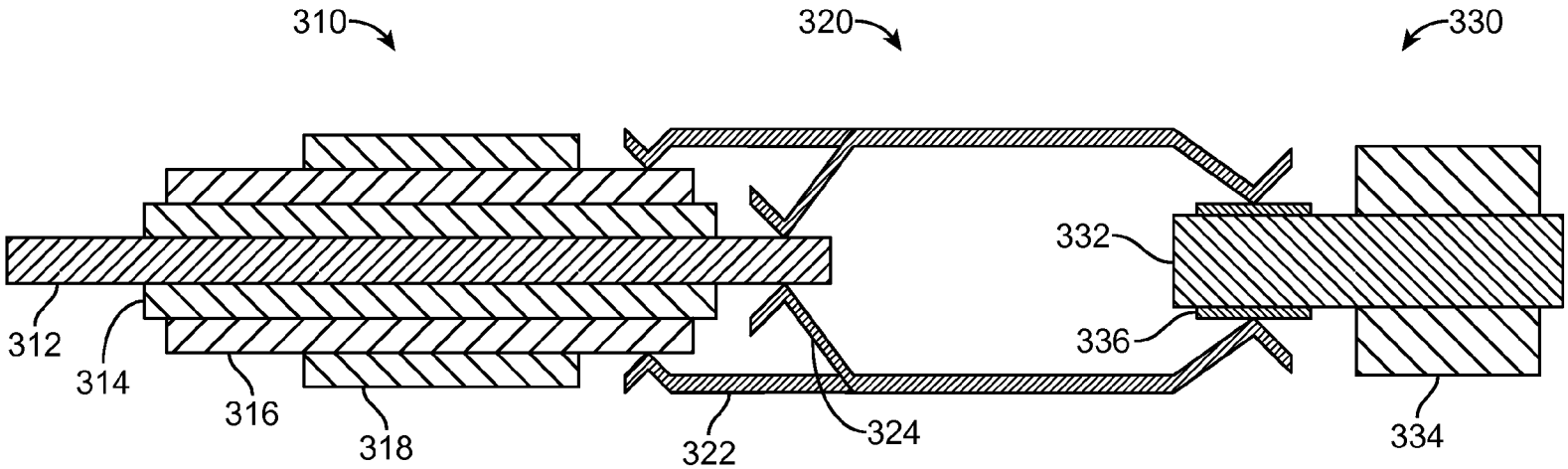
FIG. 3 illustrates a cross-section of a flex board, pins, and memory device according to an embodiment of the present invention.

FIG. 3 illustrates a cross-section of a flex board 310, pins 320, and memory device 330 according to an embodiment of the present invention. Flex board 310 may include a center ground plane 312. Center ground plane 312 may have an insulative layer 314 on each side. Traces 316 may reside on insulative layers 314. Optional outer insulative layer 318 may be included to protect traces 316.

In other embodiments of the present invention, other layers may be in included as part of flex board 310. For example, one or both of outer insulative layers 318 may be omitted. Alternately, shield layers (not shown) may be placed on the outside of layers 318 to provide electromagnetic shielding. These shield layers may be tied to ground or other low impedance point. The shield layers may be further protected by another insulative layer (not shown.) In still other embodiments of the present invention, center ground plane 312 may be replaced by an insulative layer having a conductive ground layer on each side.

In various embodiments of the present invention, ground 312 and trace signal lines 316 may be formed using copper, aluminum, or other conductive material. Insulative layers 314 and 318 may be formed using polyamide material or other insulative materials.

Pins 320 may form electrical connections between memory device 330 and board 310. Pins 320 may include ground pins 324 and signal pins 322. Signal pins 322 may form signal paths from memory device 330 to signal traces 316 on flex board 310. Pins 324 may form ground connections between memory device 330 and ground plane 312 in flex board 310.

Memory device 330 may include memory circuits 334 attached to printed circuit board 332. Traces (not shown) may connect memory circuits 334 to contact areas 336 on memory device 330.

Again, flex board 310 may use microstrips to reduce crosstalk and EMI from data signals on traces 316. This reduces the unshielded distance to the length of pins 320 and any pins that may be needed to connect flex board 310 to a printed circuit board (not shown.) In a specific embodiment of the present invention, this distance may be on the order of 4-5 mm, as compared to a conventional 10-12 mm. By minimizing this unshielded distance, crosstalk, EMI and other emissions are reduced. This in turn reduces interference with other circuitry, such as wireless transceivers, graphics and audio, as well as other types of circuits.

Again, in other embodiments of the present invention, flex board 310 may be replaced with a printed circuit board, ribbon cable, or other conduit. In a specific embodiment of the present invention, an edge of a printed circuit board, such as a mother board, may replace the flex board 310. In this embodiment, signal pins 322 may contact pads connected to conductive traces on the printed circuit board. Ground pins 324 may contact a center ground plane that extends beyond an edge of the printed circuit board, or ground pins 324 may contact ground pads may be made available on the surface of the printed circuit board.

Figure 4:
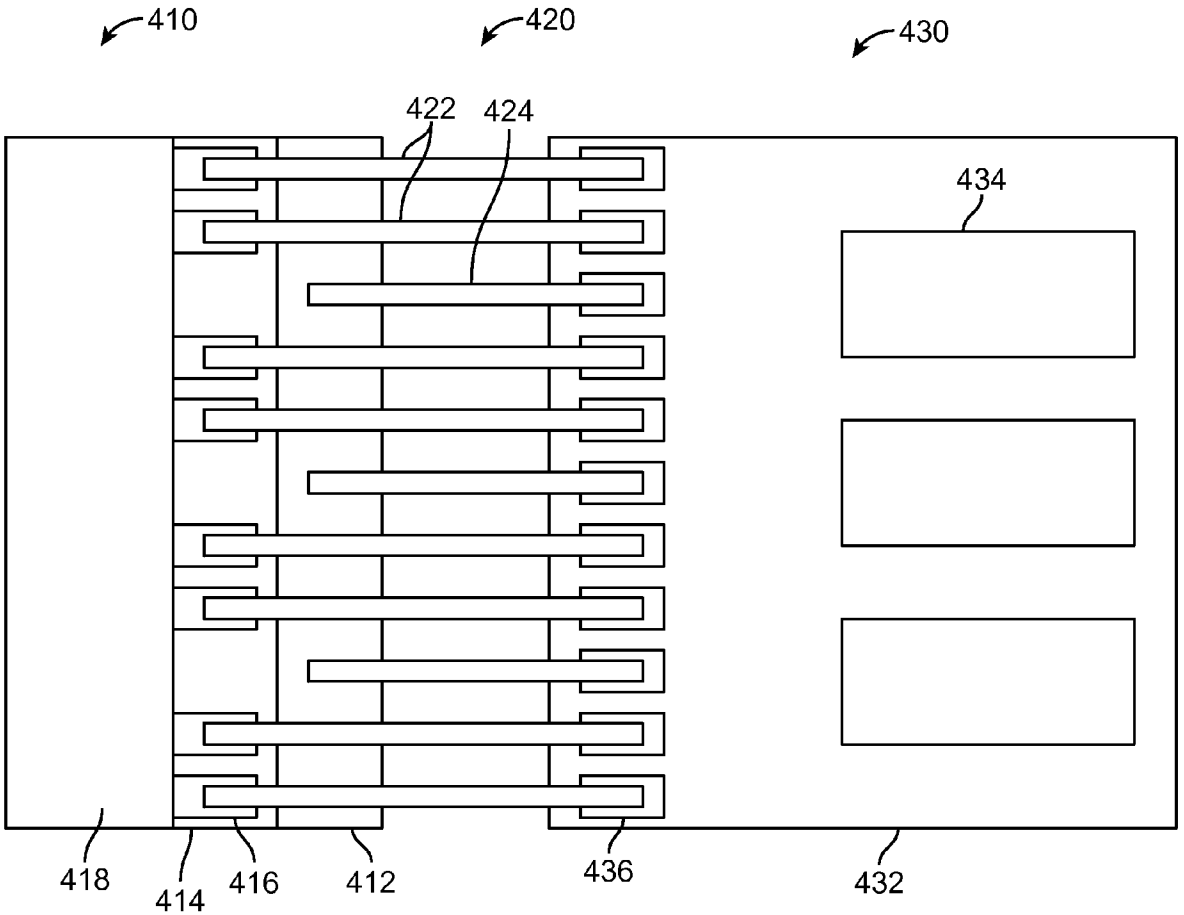
FIG. 4 illustrates a top view of flex board, pins, and memory device according to an embodiment of the present invention.

FIG. 4 illustrates a top view of flex board 410, pins 420, and memory device 430 according to an embodiment of the present invention. Flex board 410 may include ground plane 412, insulative layer 414, and conductive traces 416. Conductive traces 416 may be protected by optional insulating layers 418. Pins 422 and 424 may form electrical connections between flex board 410 and memory device 430. Signal pins 422 may connect signal traces 416 to pads 436 on memory device 430. Ground pins 424 may connect ground plane 412 to pads 436 on memory device 430. Memory circuits 434 may be soldered or otherwise attached to board 432. Traces (not shown) may connect memory circuits 434 to pads 436.

In this example, pairs of data or signal pins 422 may have a ground pin 424 on each side. This may create a microstrip structure. This microstrip structure may electrically isolate pairs of data pins 422. As data signals on these data pins switch, this microstrip arrangement may limit the electromagnetic interference generated by memory device 430. Crosstalk, that is electromagnetic interference between pairs of data pins, may be similarly reduced. This, in turn, may enhance signal integrity and allow memory device 430 to operate at higher data rates.

In various embodiments of the present invention, it may be desirable to provide a socket or connector for more than one memory device. Examples are shown in the following figures.

Figure 5:
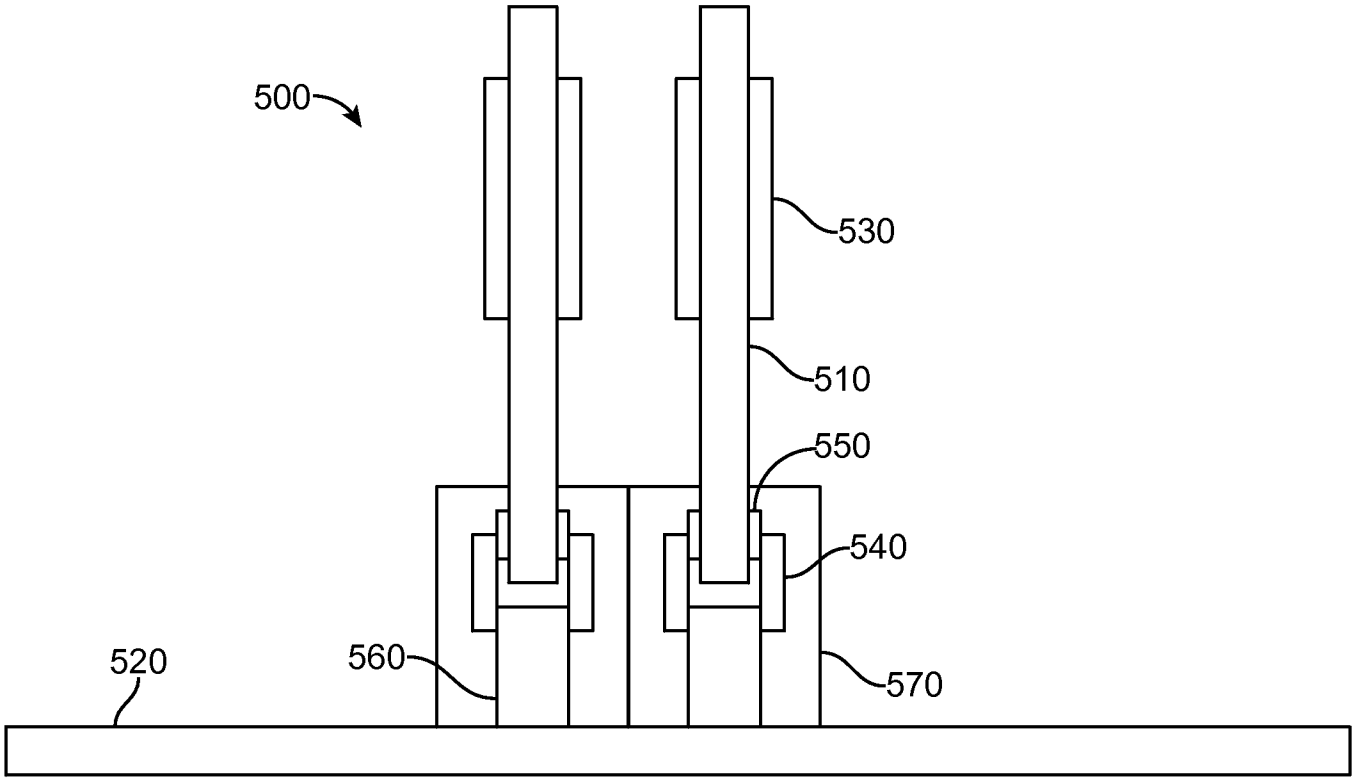
FIG. 5 illustrates a socket or connector according to an embodiment of the present invention.

FIG. 5 illustrates a connector 500 according to an embodiment of the present invention. In this example, connector 500 may connect two memory devices 510 to printed circuit board 520. Memory device 510 may be an SODIMM or other type of memory board, module, or device. Memory device 510 may include a number of memory circuits 530, which may be integrated circuits. Signals generated by circuitry on, or associated with, printed circuit board 520 may be provided to memory devices 510 through a conductive path including flex boards 560, pins 540, contacts 550, and traces (not shown) on in the memory devices 510. Data from memory devices 530 may be provided to circuitry on, or associated with, printed circuit board 520 via a path including traces (not shown) on memory device 510, contacts 550, pins 540, and flex board 560.

Again, printed circuit board 520 may be a motherboard or a daughterboard. For example, printed circuit board 520 may be a graphics card, audio card, or other type of support. While a printed circuit board 520 is shown for exemplary purposes, flex boards 560 may connect to another type of board, for example a flex board or other type of board.

Flex boards 560 may provide an electrical conduit from pins 540 to printed circuit board 520. Flex boards 560 may include microstrips to shield signals transferred between memory devices 510 and printed circuit board 520. Connector or socket 500 may be enclosed in a housing 570.

In various embodiment of the present invention, pins 540 may be formed using aluminum, copper, or other metallic or conductive material. Flex boards 560 may be formed of a plurality of layers including the metal and insulative layers. Housing 570 may be made of plastic or other nonconductive material. Housing 570 may be mechanically reinforced using a metallic frame or other type of structure.

Figure 6:
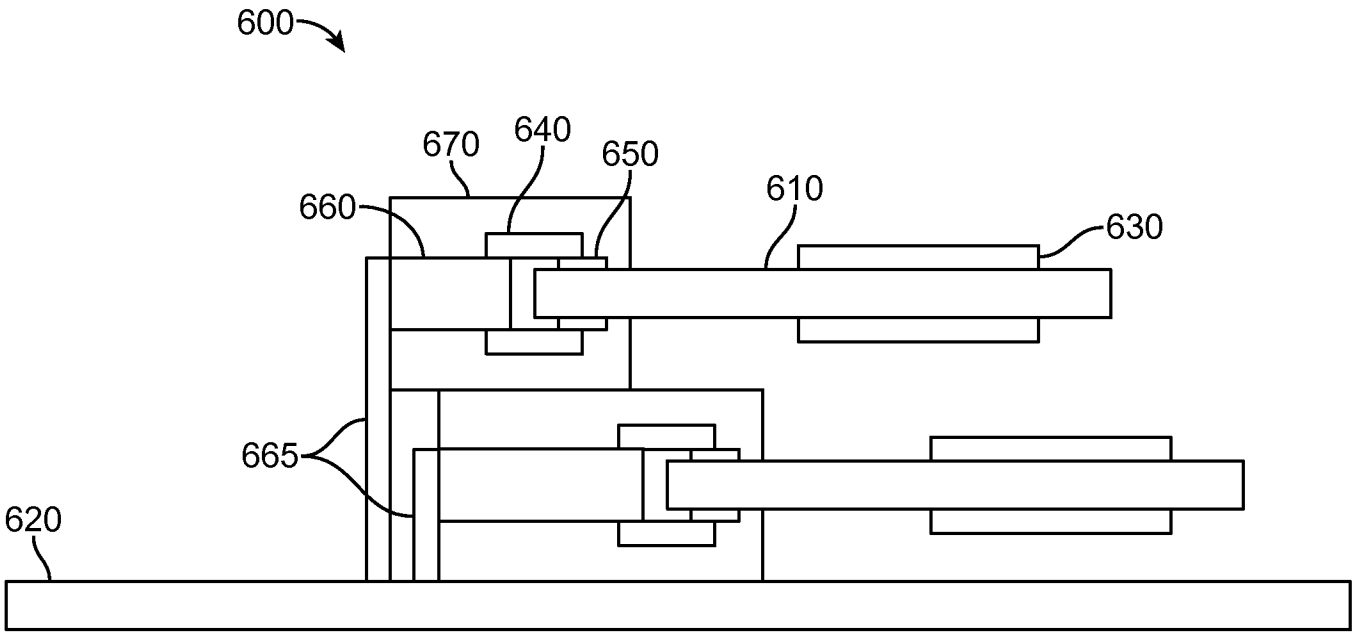
FIG. 6 illustrates a socket or connector according to an embodiment of the present invention.

FIG. 6 illustrates a socket or connector 600 according to an embodiment of the present invention. In this configuration, memory devices 610 may be parallel to printed circuit board 620 when they are inserted in connector 600. Again, memory devices 610 may include memory circuits 630 and contacts 650. Memory devices 610 may be SODIMMs or other type of memory circuits, modules, or devices. Connector 600 may include pins 640 that make electrical connections between contacts 650 and flex boards 660. In this example, additional pins 665 may be used to form connections between flex boards 660 and printed circuit board 620. Connector 600 may be enclosed in housing 670.

In various embodiments of the present invention, pins 640 may be formed using aluminum, copper, or other metallic or conductive material. Flex boards 660 may be formed of a plurality of layers including metal and insulative layers. Housing 670 may be made using plastic or other nonconductive material. Housing 670 may be mechanically reinforced using a metallic or other type of reinforcing structure.

Figure 7:
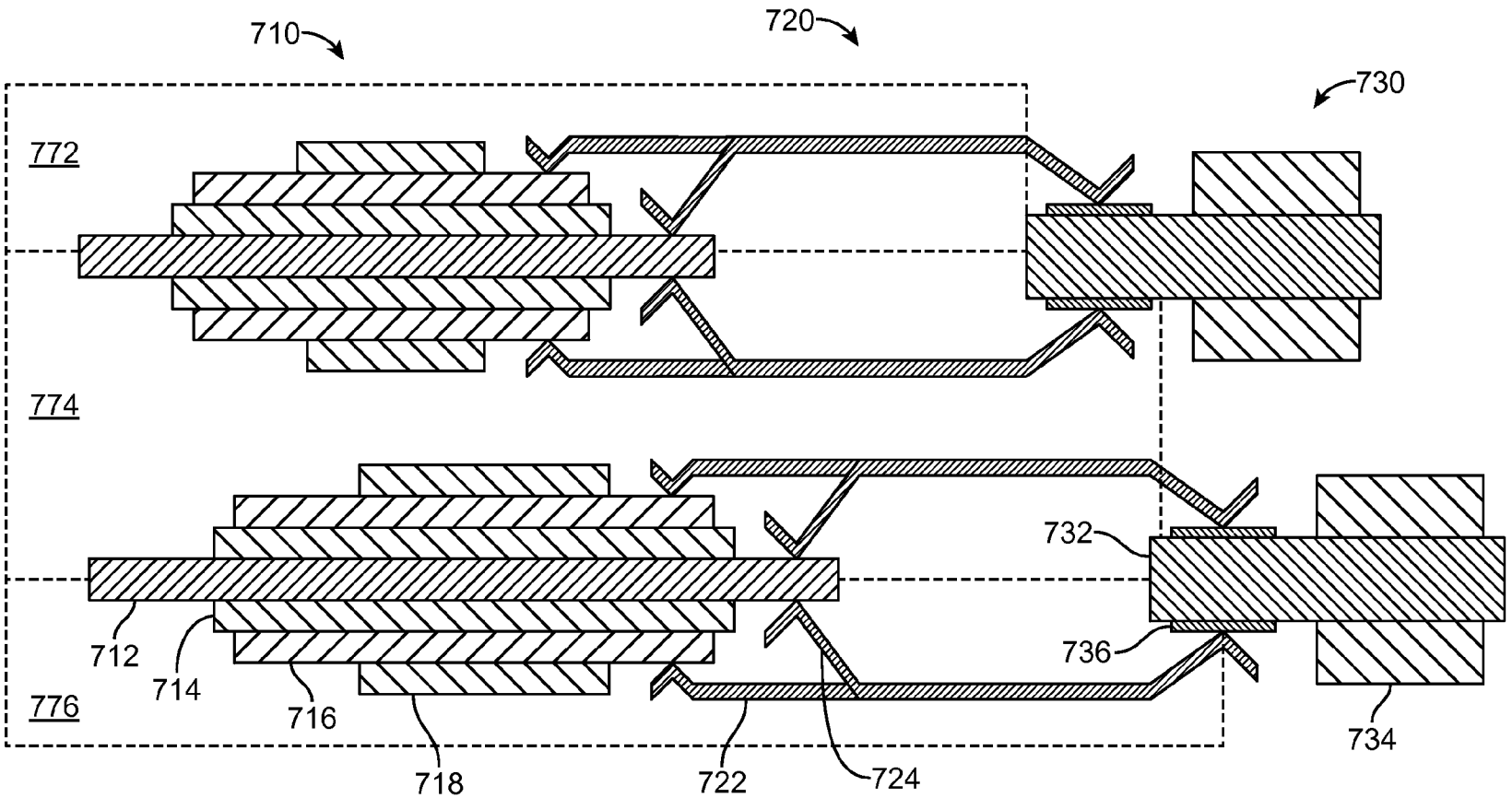
FIG. 7 illustrates a cross-section of flex boards, pins, and memory devices according to an embodiment of the present invention.

FIG. 7 illustrates a cross-section of flex boards 710, pins 720, and memory devices 730 according to an embodiment of the present invention. Flex boards 710 may include center ground planes 712. Center ground planes 712 may have insulative layers 714 on each side. Traces 716 may reside on insulative layers 714. Optional outer insulative layer 718 may be included to protect traces 716.

In other embodiments of the present invention, other layers may be in included as part of flex boards 710. For example, one or both of outer insulative layers 718 may be omitted. Alternately, shield layers (not shown) may be placed on the outside of layers 718 to provide electromagnetic shielding. These shield layers may be tied to ground or other low impedance point. The shield layers may be further protected by another insulative layer (not shown.) In still other embodiments of the present invention, center ground planes 712 may be replaced by insulative layers having conductive ground layers on each side.

In various embodiments of the present invention, center ground planes 712 and trace signal lines 716 may be formed using copper, aluminum, or other conductive material. Insulative layers 714 and 718 may be formed using polyamide or other insulative materials.

Pins 720 may form electrical connections between memory devices 730 and board 710. Pins 720 may include ground pins 724 and signal pins 722. Signal pins 722 may form signal paths from memory devices 730 to signal traces 716 on flex boards 710. Pins 724 may form ground connections between memory device 730 and center ground planes 712 in flex boards 710.

Memory devices 730 may include memory circuits 734 attached to printed circuit board 732. Traces (not shown) may connect memory circuits 734 to contact areas 736 on memory devices 730.

Embodiments of the present invention may incorporate one or more flex boards to carry signal and grounds. The signal lines may be arranged in a microstrip fashion to reduce the amount of electromagnetic interference that is generated and to improve signal integrity. An example of such a flex board is shown in the following figure.

Figure 8:
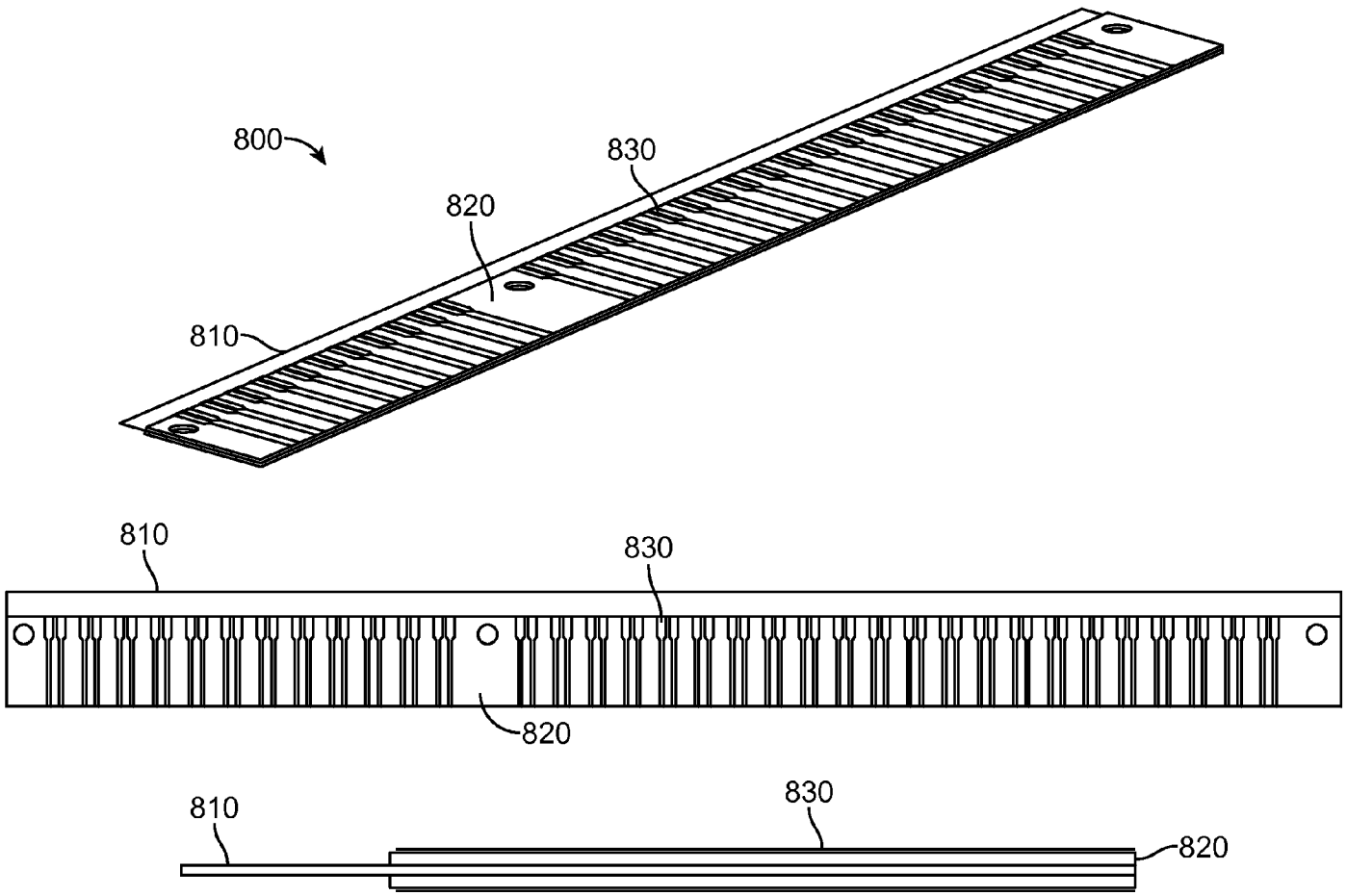
FIG. 8 illustrates a flex board according to an embodiment of the present invention.

FIG. 8 illustrates a flex board 800 according to an embodiment of the present invention. Flex board 800 may include ground plane 810, insulative layers 820, and conductive traces 830. In a specific embodiment of the present invention, conductive traces 830 are sized and spaced to provide an impedance of approximately 40 or 50 ohms. In various embodiments of the present invention, various numbers of conductive traces may be included. For example, 68, or other number of traces, may be included on each side of one or more flex boards 800. In a specific embodiment of the present invention, flex board 800 is 68 mm wide.

In a specific embodiment present invention, center ground plane 810 may be formed using copper, aluminum, or other conductive material. In a specific embodiment of the present invention, copper having a weight of 2 oz. and a thickness of 0.07 mm may be used. In this embodiment of the present invention, insulative layers 820 may be formed using polyamide. In a specific embodiment of the present invention, the polyamide may be 0.08 mm thick. In this embodiment of the present invention, signal traces 830 may be formed using copper, aluminum, or other conductive material. In a specific embodiment of the present invention, ½ oz. of copper having a thickness of 0.018 mm may be used. Signal traces 830 may terminate in pads, where the pads are wider than signal traces 830. In a specific embodiment of the present invention, the pads may be 0.45 mm wide, with a gap of 0.15 mm between pads. A gap of 0.75 mm may separate signal traces 830. In other embodiments of the present invention, other thicknesses, sizes, and spacings may be used.

Again, in a specific embodiment of the present invention, a socket or connector for two memory devices may be provided. One such socket or connector may be formed using three major pieces. An example is shown in the following figures.

Figure 9:
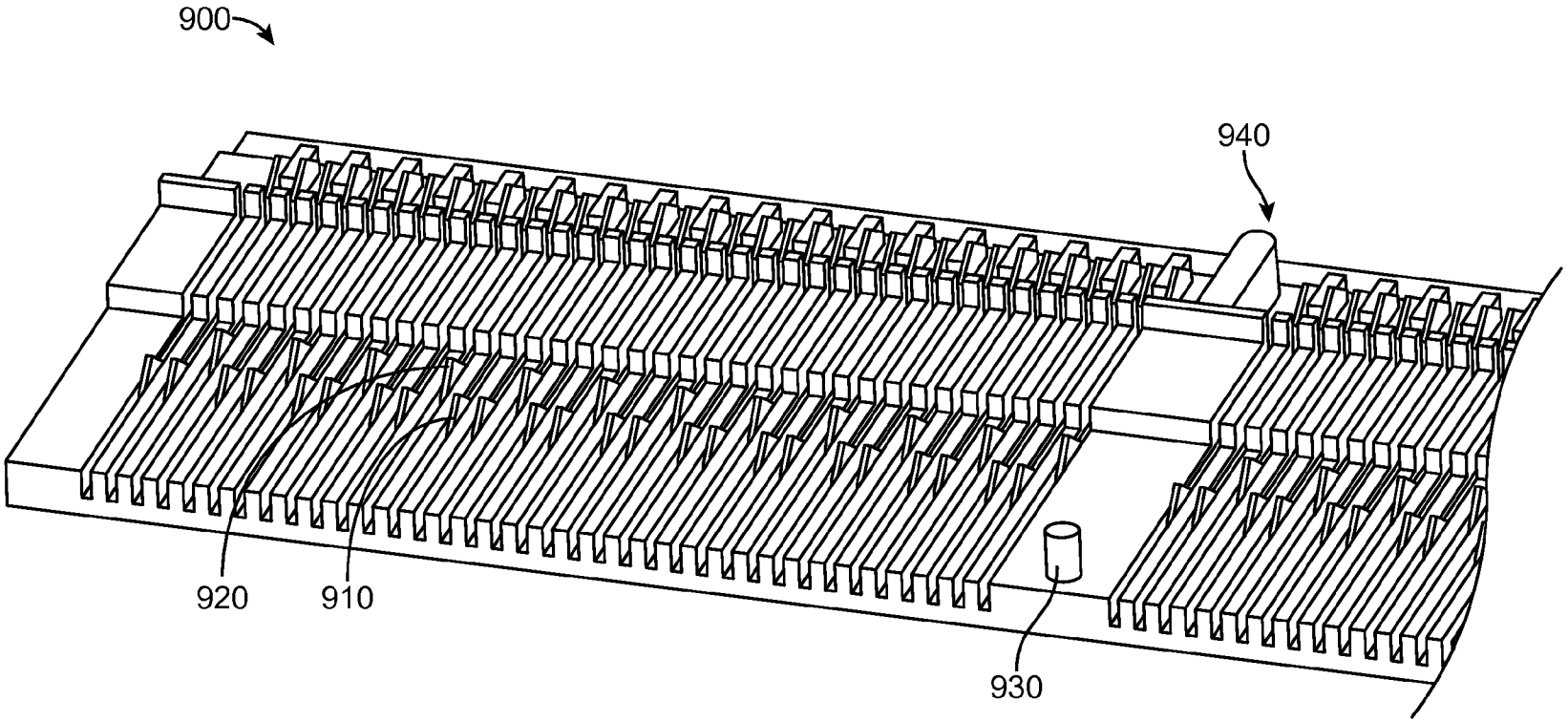
FIGS. 9-15 illustrate steps in the assembly of a socket or connector according to an embodiment of the present invention.

FIG. 9 illustrates a first or bottom piece 900 of a high-speed memory socket or connector according to an embodiment of the present invention. Pins 910 and 920 may be inserted into piece 900 to form connections between a memory device and a flex board. In a specific embodiment of the present invention, 68 signal pins 910 and 34 ground pins 920 may be used, for a total of 102 pins. Post 930 may act as an alignment mechanism for later pieces. Notch 940 may be offset from a center of piece 900 in order to prevent memory devices from being inserted improperly by a user. After assembly, pins 910 and 920 may form connections with contacts on a bottom of a first memory device.

Figure 10:
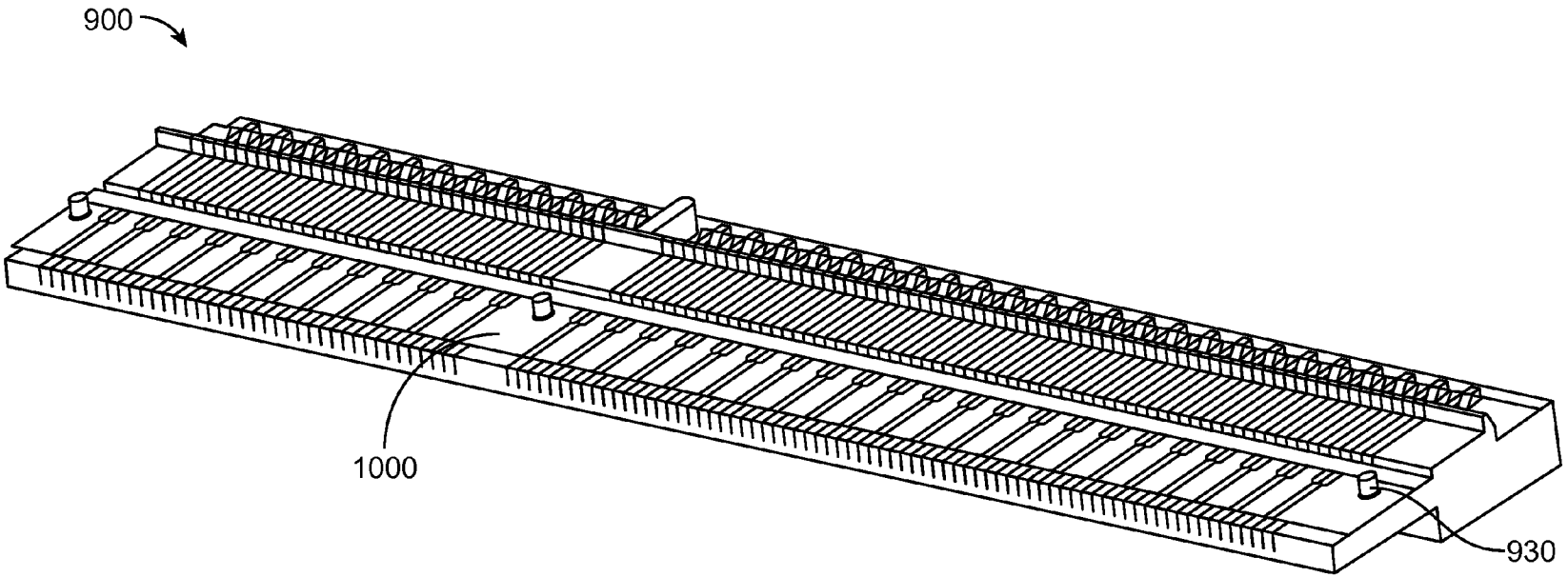

FIG. 10 illustrates a flex board 1000 placed on top of first piece 900. Holes in flex board 1000 may align with posts 930. Posts 930 may be asymmetrical to prevent flex 1000 from being installed improperly or backwards on first piece 900. In this example, three posts 930 fit in three holes in flex board 1000, though in other embodiments of the present invention, other numbers of posts and holes may be used.

Figure 11:
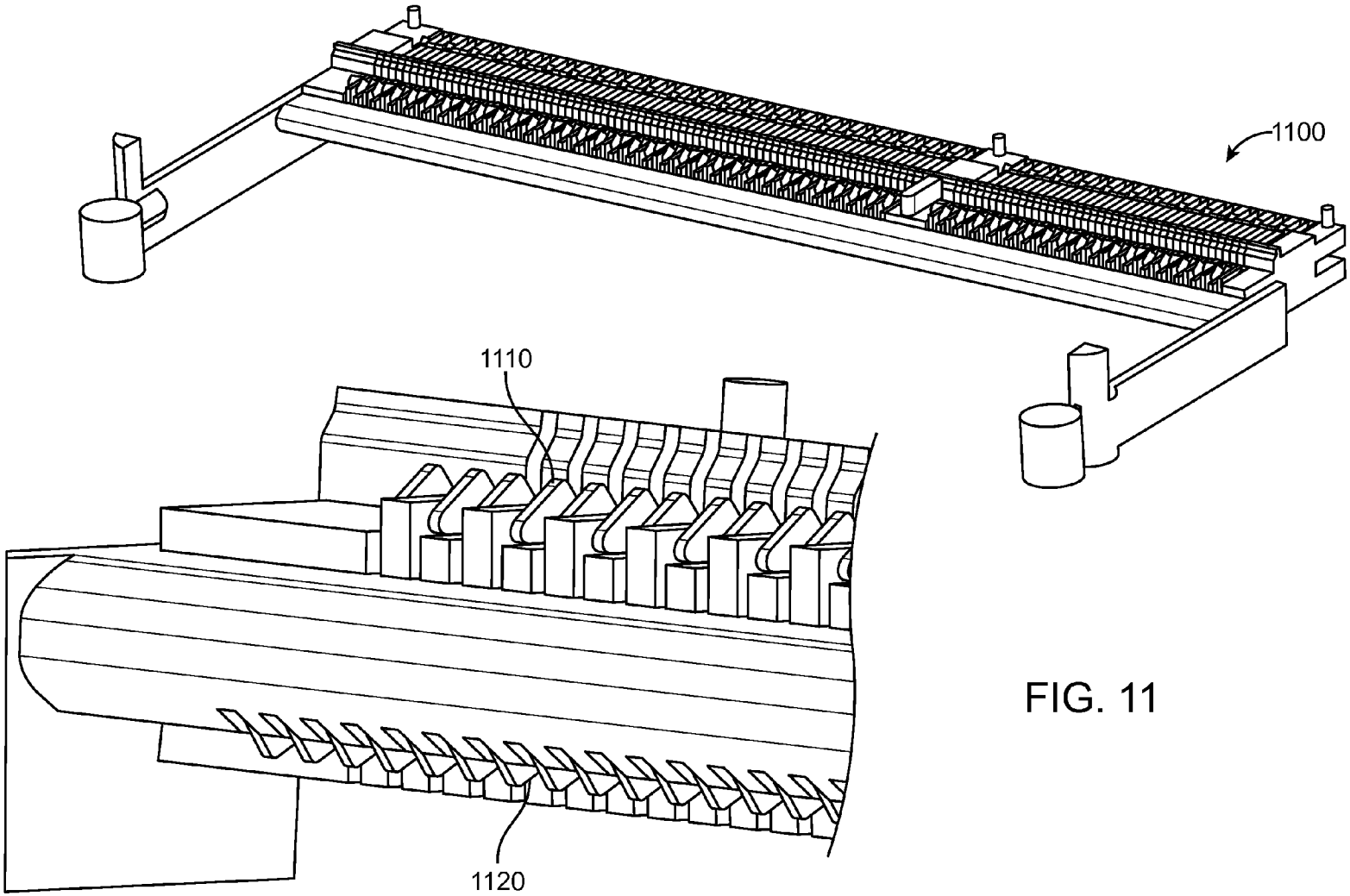

FIG. 11 illustrates a middle or second piece 1100 of a high-speed memory socket or connector according to an embodiment of the present invention. Second piece 1100 may include top pins 1110 and bottom pins 1120. As before, in a specific embodiment of the present invention, there maybe 68 signal pins and 34 ground pins for a total of 102 top pins 1110, and 68 signal pins and 34 ground pins for a total of 102 bottom pins 1120. After assembly, top pins 1110 may form electrical connections with contacts on a bottom of a second memory device, while bottom pins 1120 may make electrical contact with top contacts on a first memory device.

Figure 12:
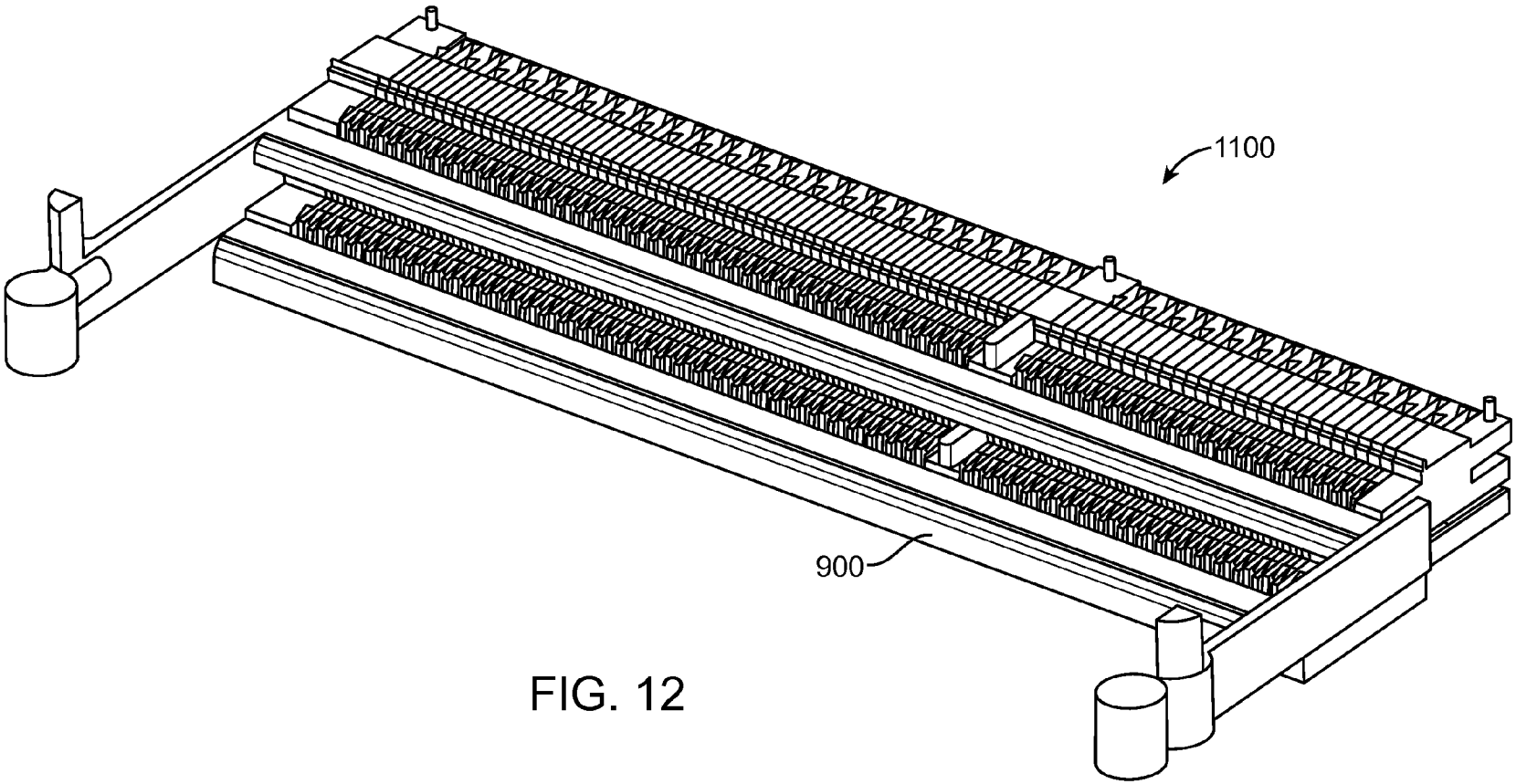

FIG. 12 illustrates middle or second piece 1100 that may be fitted to first or bottom piece 900.

Figure 13:
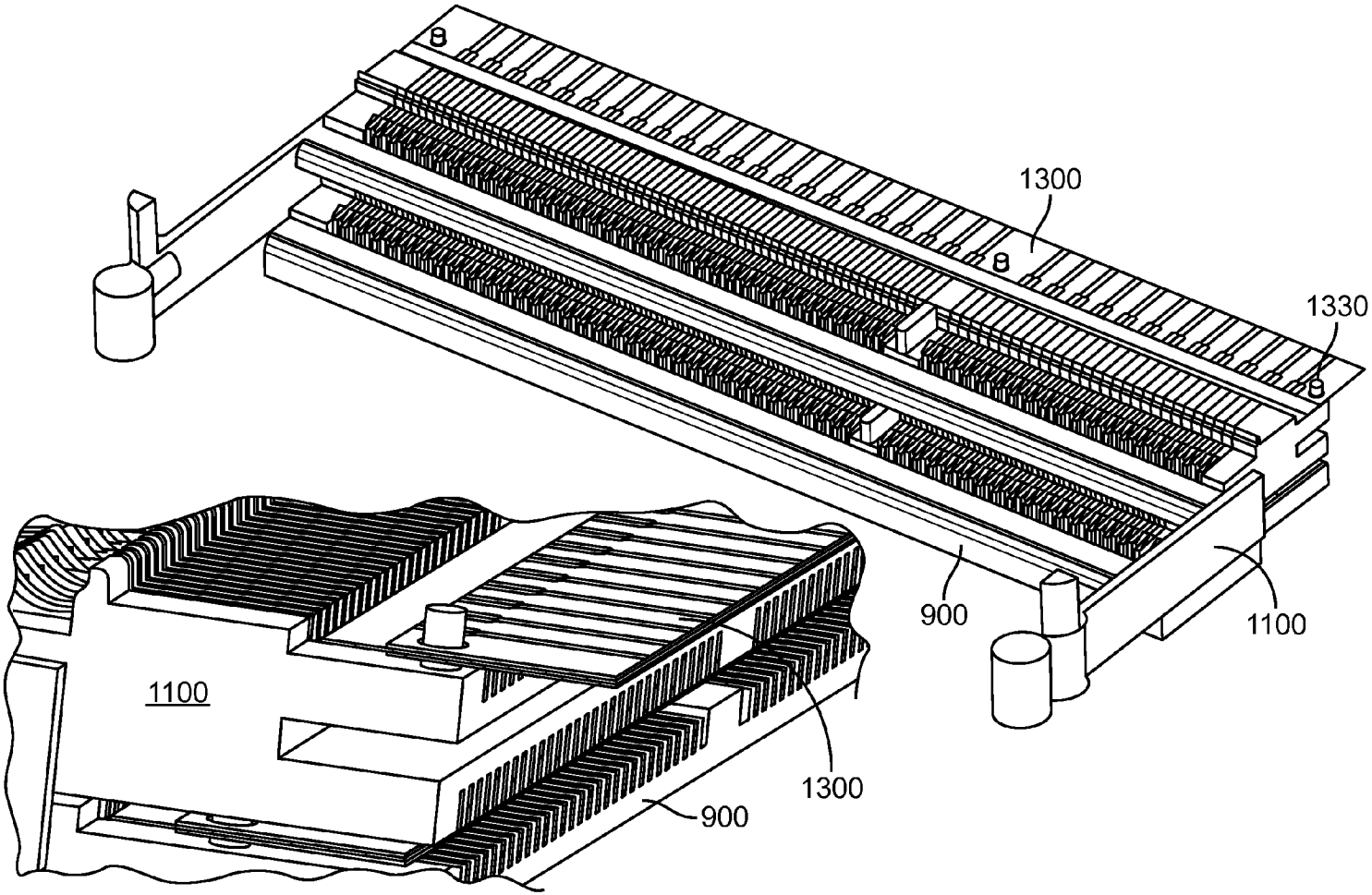

In FIG. 13, a second flex board 1300 may be fitted to middle or second piece 1100. Posts 1330 may be used to align flex board 1300 to second piece 1100. As before, posts 1330 may be asymmetrically arranged on second piece 1100 to prevent improper installation of flex board 1300.

Figure 14:
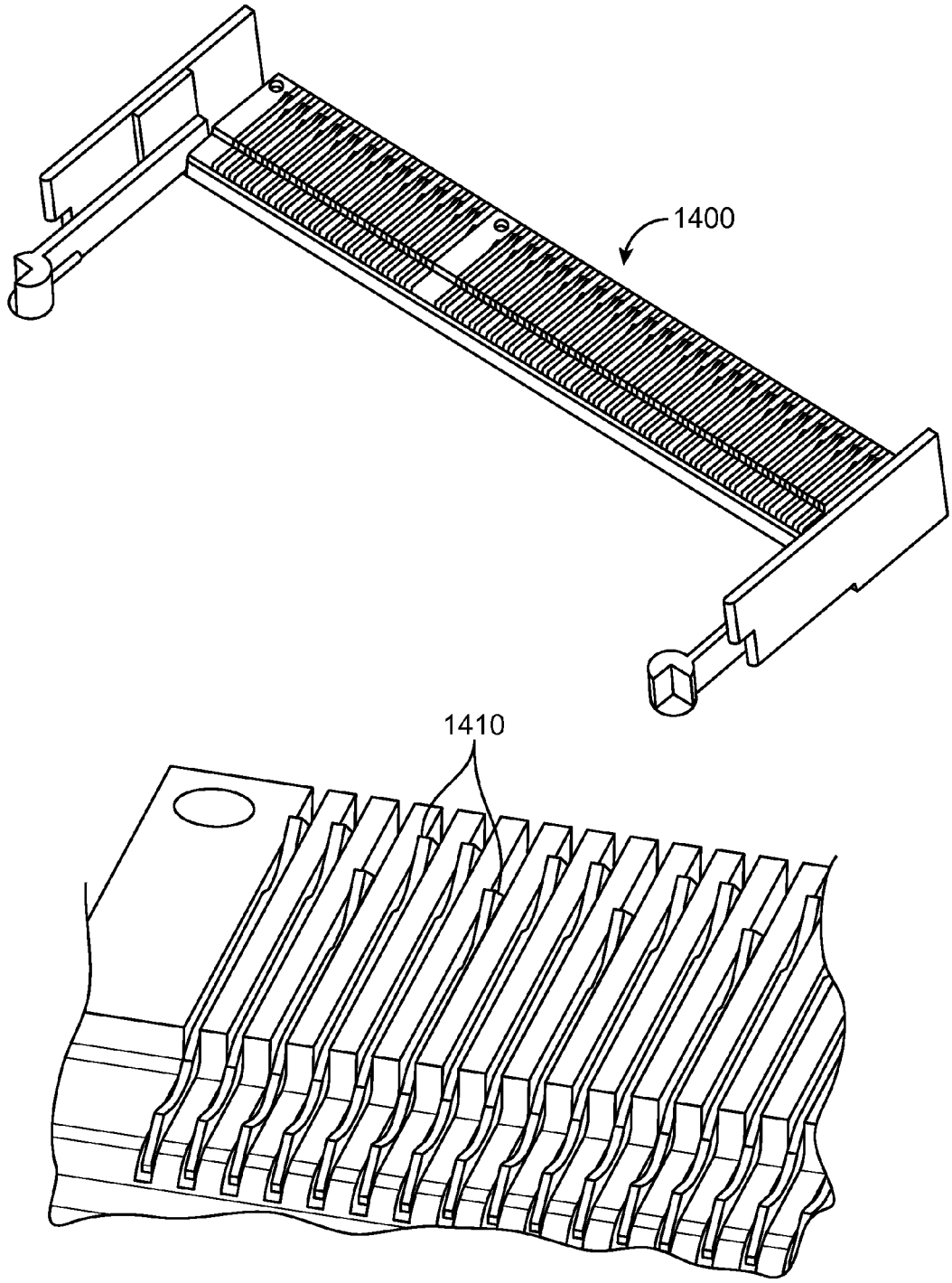

FIG. 14 illustrates a top or third piece 1400 that may be used in the assembly of a high-speed memory connector or socket according to an embodiment of the present invention. Pins 1400 may be located on top or third piece 1400. As before, there may be 68 signal pins and 34 ground pins, for a total of 102 pins 1400. After assembly, pins 1410 may form electrical connections with contacts on a top of a second memory device.

Again, users may wish to insert and extract memory devices from these high-speed memory sockets or connectors. Such insertion and removal may cause mechanical stress to the socket. Accordingly, various embodiments of the present invention may provide reinforcement for these high-speed sockets. An example is shown in the following figure.

Figure 15:
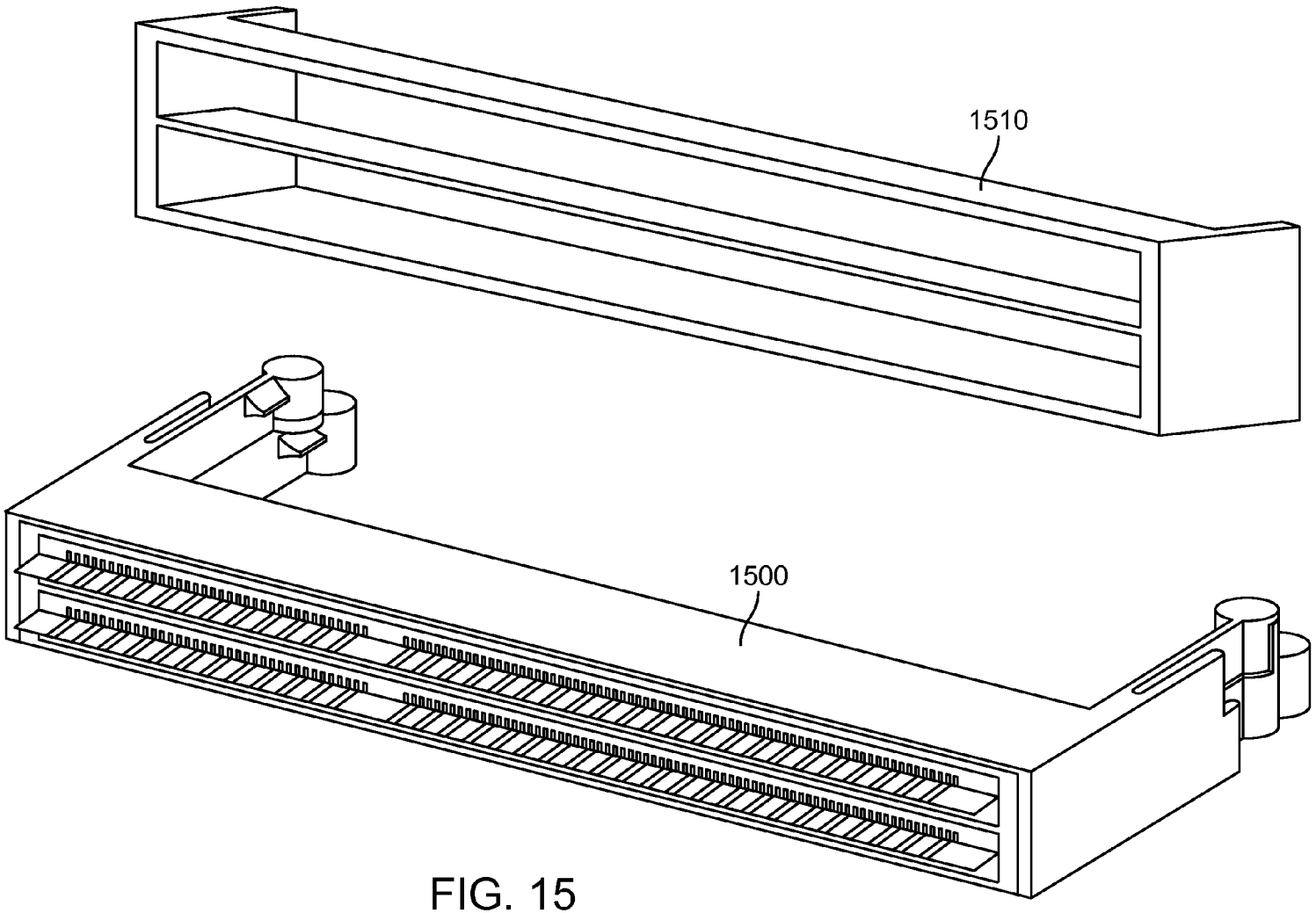

FIG. 15 illustrates a frame 1510 that may be used to provide mechanical reinforcement for socket or connector 1500. In a specific embodiment of the present invention, frame 1510 may be made of metal, for example steel, stainless steel, or other rigid material. Frame 1510 may fit around or inside socket 1500. In a specific embodiment of the present invention, frame 1510 may fit inside pieces forming socket 1500 such that frame 1510 is not visible from the top, side, or front when viewed by a user.

Figure 16:
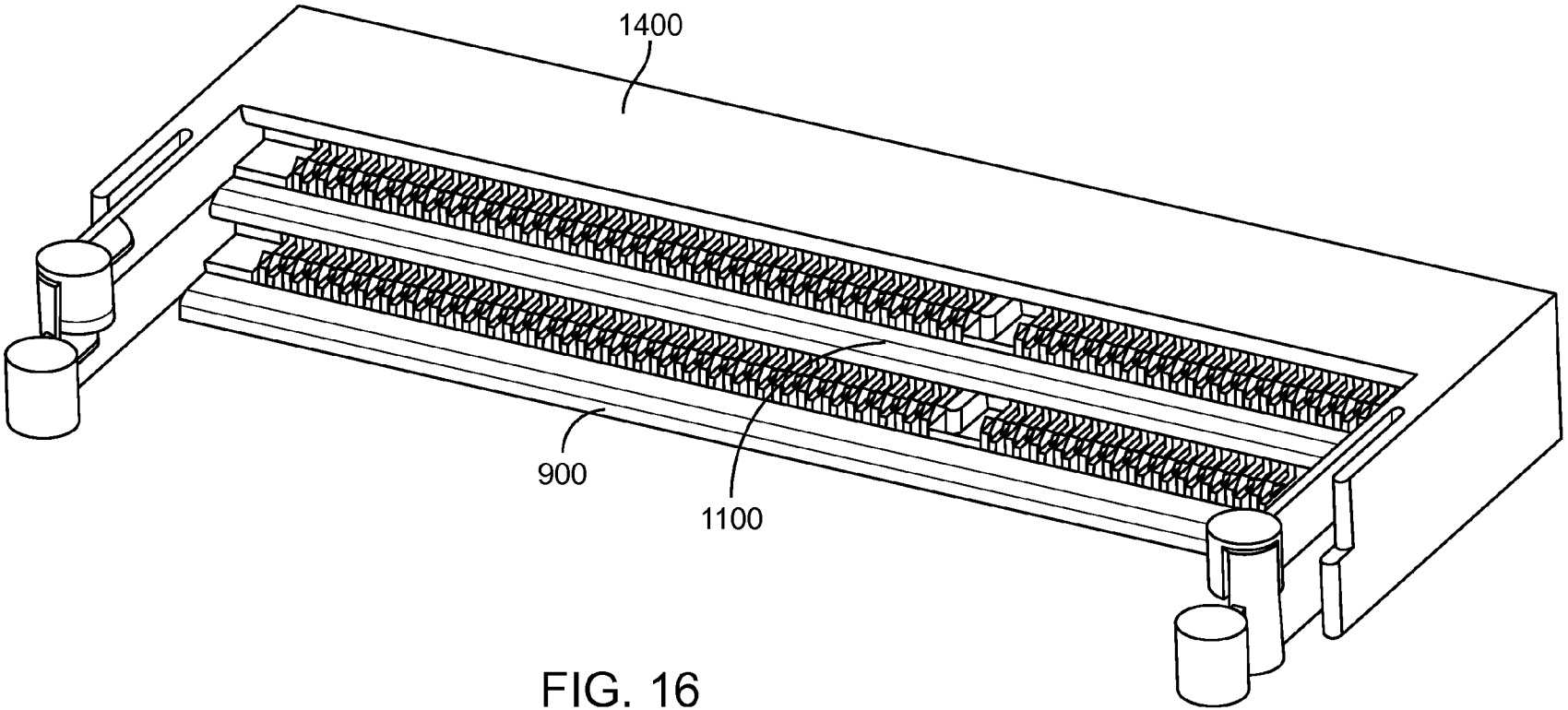
FIG. 16 illustrates a completed socket or connector according to an embodiment of the present invention.

FIG. 16 illustrates a completed socket or connector according to an embodiment of the present invention. This socket or connector may include a bottom or first piece 900, middle or second piece 1100, and top or third piece 1400. These pieces may be fixed to each other by screws, fasteners, adhesive, or in other manners. A first memory device may be inserted between bottom or first piece 900 and middle or second piece 1100. A second memory device may be inserted between middle or second piece 1100 and top or third piece 1400. This socket or connector may sit flush on a printed circuit board, or it may be mounted to an enclosure, or other surface. The completed socket or connector may include a total of 408 pins to form connections with the first and second memory devices, though other embodiments of the present invention may include other numbers of pins. In a specific embodiment of the present invention, the complete socket of connector has a height of 8.66 mm, though other embodiments of the present invention may have other heights.

In the above example, three pieces are used to form a completed socket or connector. In other embodiments of the present invention, more or fewer than three pieces may be used to form a completed socket. For example, five pieces may be used to form a completed socket. In other embodiments of the present invention, the socket may be formed using a single piece. In this embodiment, the single piece may be plastic, where flex boards are inserted into an open end of the socket.

In the above embodiments of the present invention, pins are used to form electrical connections between memory devices and flex boards. Signals on the memory devices and on the flex boards are effectively shielded using microstrips to limit EMI and crosstalk. However, some EMI and crosstalk may occur due to the use of these pins. Accordingly, an embodiment of the present invention provides a direct connection between a flex board and a memory device. An example is shown in the following figure.

Figure 17:
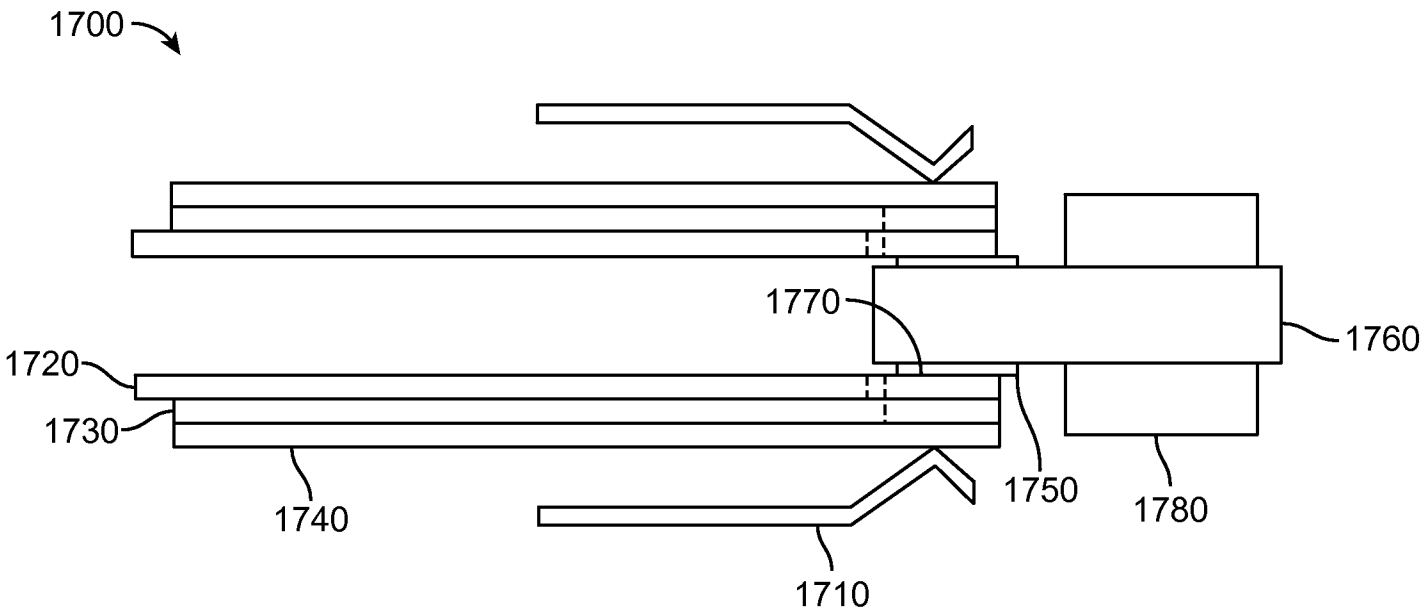
FIG. 17 illustrates a socket or connector for high-speed memory devices where a flex board is directly connected to a memory device.

FIG. 17 illustrates a socket or connector for high-speed memory devices where a flex board is directly connected to a memory device. In this example, flex board 1700 may include a ground layer 1720, insulating layer 1730, and traces 1740. A pin or mechanical finger 1710 may provide pressure on flex board 1700, thereby holding flex board 1700 against contact 1750 on memory device 1760. Vias 1770 may be used to route traces 1740 through insulating layer 1730 and ground plane 1720 such that they may make contact with contact pads 1750. Memory device 1760 may include one or more memory circuits 1780. Portions of flex board 1700 may be plated or otherwise protected to avoid damage during insertion and extraction of memory device 1760.

In various embodiments of the present invention, pins in a connector or socket may connect to one or more flex boards in various ways. An example is shown in the following figure.

Figure 18:
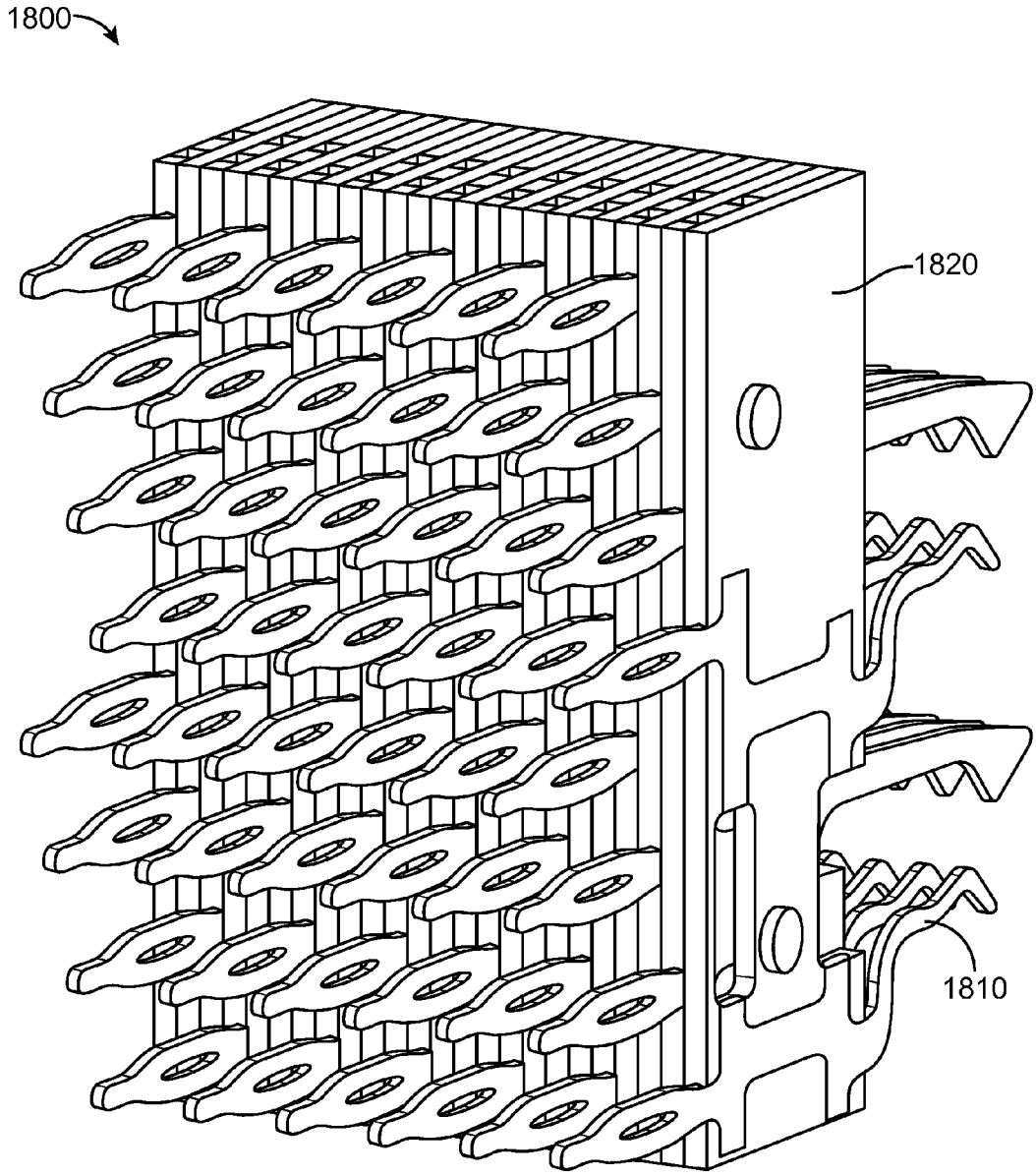
FIG. 18 illustrates a wafer stack that may be used to arrange a number of pins to electrically connect one or more memory devices to a flex board according to an embodiment of the present invention.

FIG. 18 illustrates a wafer stack 1800 that may be used to arrange a number of pins to electrically connect one or more memory devices to a flex board according to an embodiment of the present invention. Wafer stack 1800 may include pins 1810 held in place by insulative material 1820. Wafers may be stacked as needed to provide electrical connections between memory devices (not shown) and a flex board (not shown.) The pins may have two ends, a first end to mate with contacts on one or more memory devices (not shown) and a second end forming an array.

Figure 19:
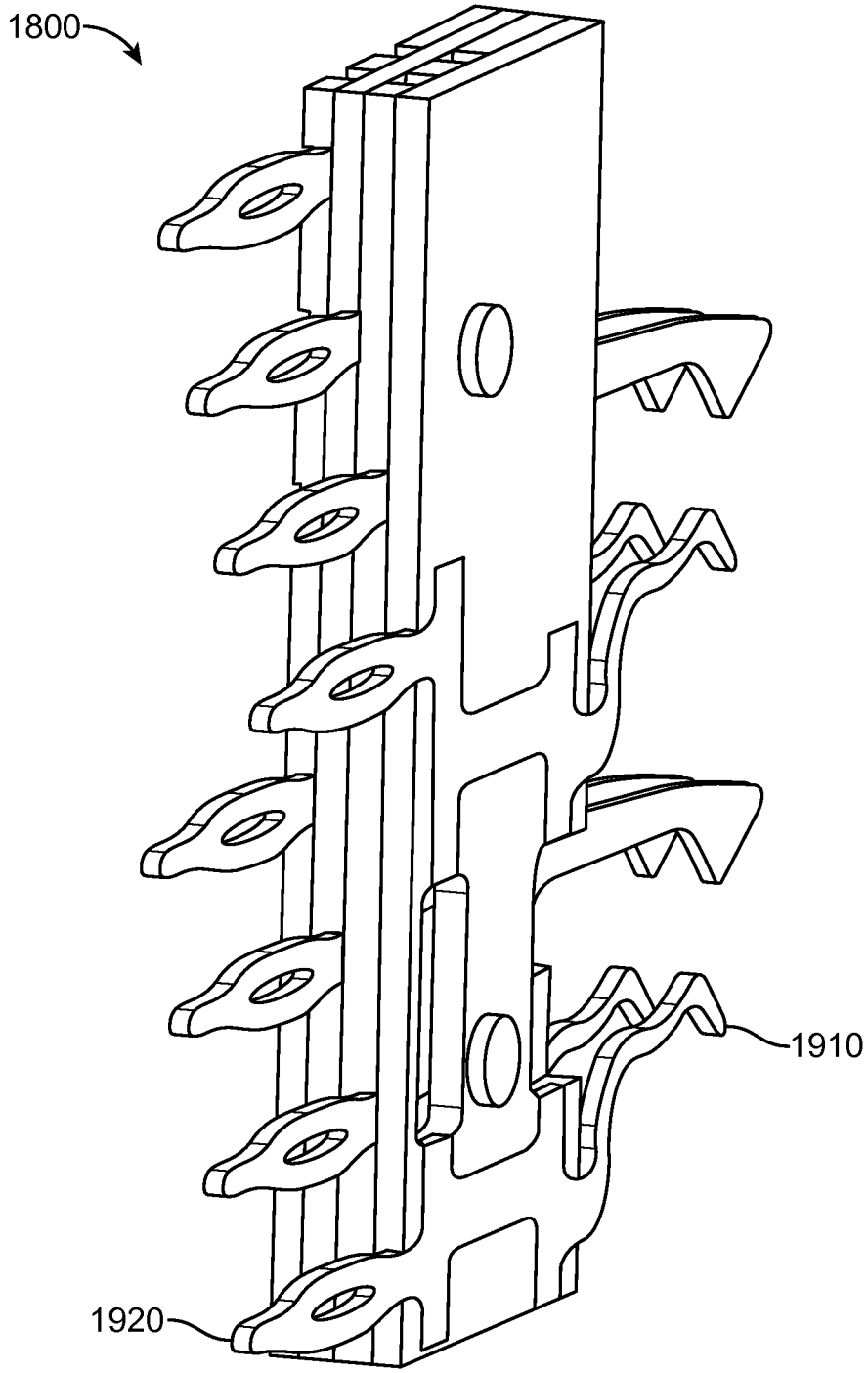
FIG. 19 illustrates a close-up of a wafer stack according to an embodiment of the present invention.

FIG. 19 illustrates a close-up of a wafer stack 1800 according to an embodiment of the present invention. Memory devices (not shown) may be inserted such that they make contact with pin portions 1810. One or more flex boards (not shown) may be attached to the wafer stack such that they make contacts with pin portions 1820.

In this specific example, four different wafers may be used. Each wafer may include two contacts, and each wafer may be used 26 times. In another embodiment of the present invention, 204 wafers may be used. In other embodiments of the present invention, other numbers of wafers and contacts may be used, and each wafer may be used a different number of times. In this specific embodiment of the present invention, each wafer may be 0.3 mm wide, though other widths may be used in other embodiments of the present invention. In various embodiments of the present invention, one or more ground pins may contact each other in the wafer stack 1800 to improve socket performance.

As the wafers are stacked, it is desirable that they be properly aligned and secured to each other. A specific embodiment of the present invention achieves alignment by providing holes and corresponding raised surfaces. An example is shown in the following figure.

Figure 20:
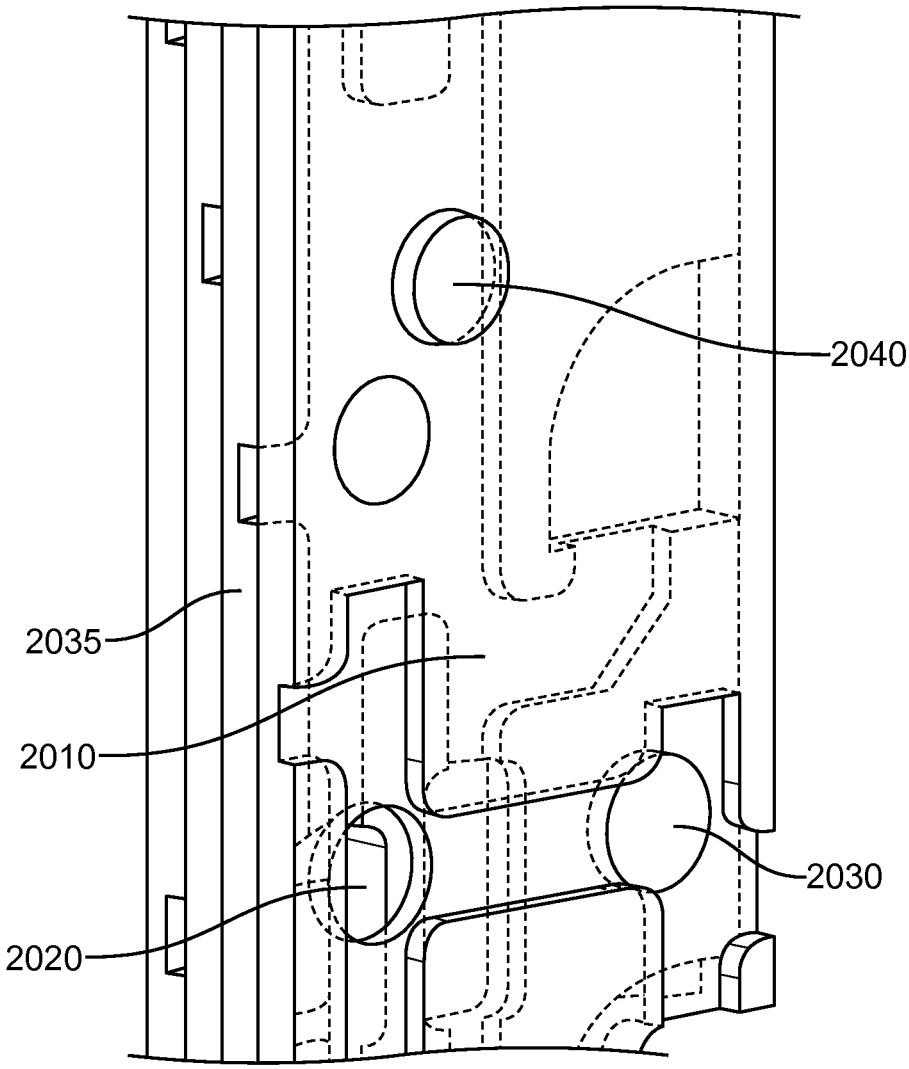
FIG. 20 illustrates a method of aligning wafer portions in a wafer stack according to an embodiment present invention.

FIG. 20 illustrates a method of aligning wafer portions in a wafer stack according to an embodiment present invention. In this example, a raised portion 2030 on a second wafer layer 2035 may mate with a hole and a first layer 2010. Similarly hole 2020 may mate with a raised portion on a next wafer (not shown), while raised portion 2040 may fit in an opening in the next wafer layer (not shown.) In this example, each wafer may include two holes for accepting raised areas from an adjoining wafer.

Figure 21:
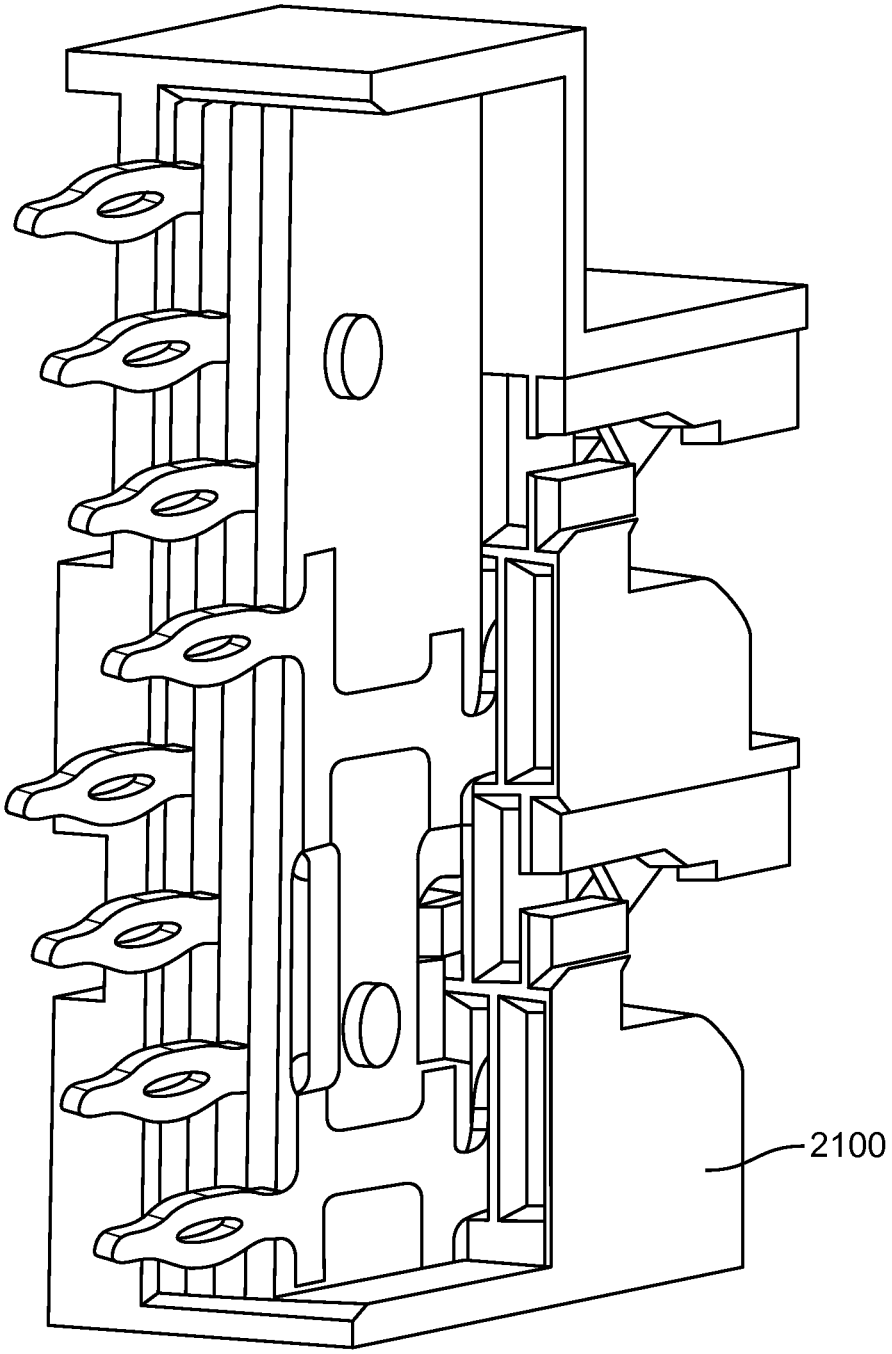
FIG. 21 illustrates a housing that may be used to hold wafers in a wafer stack according to an embodiment of the present invention.

FIG. 21 illustrates a housing 2100 that may be used to hold wafers in wafer stack 1800 according to an embodiment of the present invention.

Figure 22:
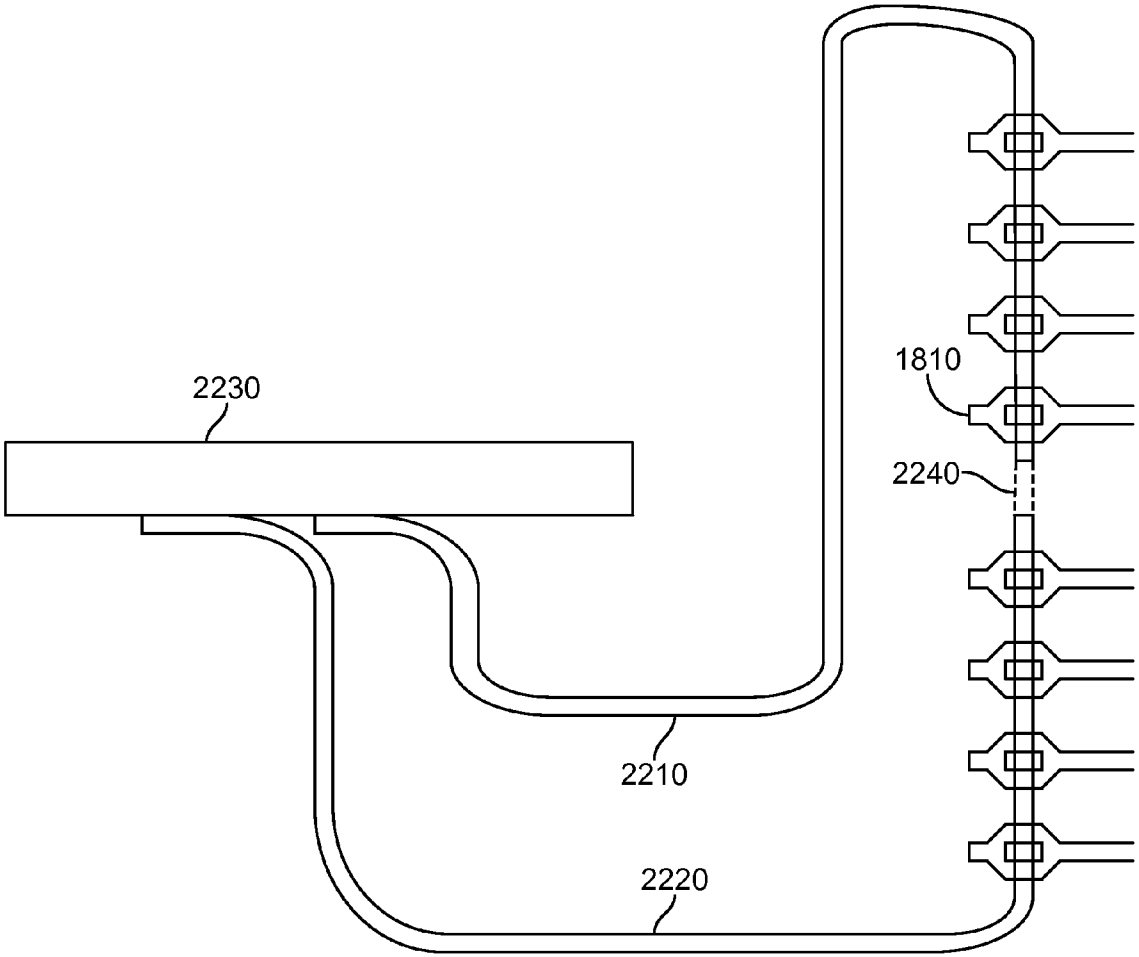
FIG. 22 illustrates a method of attaching one or more flex boards to pins of a wafer stack according to an embodiment of the present invention.

FIG. 22 illustrates a method of attaching one or more flex boards to pins of a wafer stack according to an embodiment of the present invention. Contacts 1810 from a wafer stack (not shown) may fit in through holes in flex boards 2210 and 2220. Flex boards 2210 and 2220 may be attached to printed circuit board 2230. For example, flex boards 2210 and 2220 may be press fit to printed circuit board 2230. Flex boards 2210 and 2220 may be two separate flex boards, or they may be one flex board as indicated by dashed lines 2240.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A socket comprising:

a flexible circuit board comprising:

a ground plane having a top surface and a bottom surface;

a first insulating layer at least partially covering the top surface;

a second insulating layer at least partially covering the bottom surface;

a first plurality of conductive traces on the first insulating layer and a second plurality of conductive traces on the second insulating layer; and a third insulating layer at least partially covering the first plurality of conductive traces and a fourth insulating layer at least partially covering the second plurality of conductive traces;

a plurality of pins coupled to the flexible circuit board, wherein a first number of the plurality of pins couple to the ground plane and a second number of the plurality of pins couple to the first plurality of conductive traces and the second plurality of conductive traces; and a housing to mechanically support the plurality of pins.

2. The socket of claim 1 wherein the first plurality of conductive traces and the second plurality of conductive traces are arranged as microstrips.

3. The socket of claim 1 wherein the first number of pins and the second number of pins are arranged inside of the housing.

4. The socket of claim 3 wherein the housing comprises a first opening for receiving a first memory device and a second opening for receiving a second memory device.

5. The socket of claim 4 wherein the housing further comprises a frame to provide mechanical support for the socket.

6. A method of assembling a socket comprising:

inserting a first plurality of pins in a first housing portion, the first housing portion having a plurality of slots on a top surface for holding the first plurality of pins, placing a first flexible circuit board over a portion of the first housing;

inserting a second plurality of pins and a third plurality of pins in a second housing portion, the second housing portion having a plurality of slots on a bottom surface for holding the second plurality of pins and a plurality of slots on a top surface for holding the third plurality of pins;

placing the second housing portion over the first housing portion, such that the first flexible circuit board is at least partially between the first housing portion and the second housing portion;

placing a second flexible circuit board over a portion of the second housing;

inserting a fourth plurality of pins in a third housing portion, the third housing portion having a plurality of slots on a bottom surface for holding the third plurality of pins, and placing the third housing portion over the second housing portion, such that the second flexible circuit board is at least partially between the second housing portion and the third housing portion, wherein the first housing portion comprises a plurality of posts and the second housing portion comprises a plurality of holes, wherein the plurality of posts of the first housing portion fit in the plurality of holes in the second housing portion during assembly.

7. The method of claim 6 wherein the first flexible circuit board comprises:

a center conductor having a top surface and a bottom surface;

a first insulating layer at least partially covering the top surface; and a second insulating layer at least partially covering the bottom surface.

8. The method of claim 6 wherein the first housing portion, the second housing portion, and the third housing portion are plastic and the frame is metallic.

9. A method of assembling a socket comprising:

inserting a first plurality of pins in a first housing portion, the first housing portion having a plurality of slots on a top surface for holding the first plurality of pins, placing a first flexible circuit board over a portion of the first housing;

inserting a second plurality of pins and a third plurality of pins in a second housing portion, the second housing portion having a plurality of slots on a bottom surface for holding the second plurality of pins and a plurality of slots on a top surface for holding the third plurality of pins;

placing the second housing portion over the first housing portion, such that the first flexible circuit board is at least partially between the first housing portion and the second housing portion;

placing a second flexible circuit board over a portion of the second housing;

inserting a fourth plurality of pins in a third housing portion, the third housing portion having a plurality of slots on a bottom surface for holding the third plurality of pins, and placing the third housing portion over the second housing portion, such that the second flexible circuit board is at least partially between the second housing portion and the third housing portion, wherein the first housing portion comprises a plurality of posts and the first flexible circuit board comprises a plurality of holes, wherein the plurality of posts of the first housing portion fit in the plurality of holes in the first flexible circuit board during assembly.

10. The method of claim 9 wherein the first flexible circuit board comprises:

a center conductor having a top surface and a bottom surface;

a first insulating layer at least partially covering the top surface; and a second insulating layer at least partially covering the bottom surface.

11. The method of claim 9 wherein the first housing portion, the second housing portion, and the third housing portion are plastic and the frame is metallic.

12. A method of assembling a socket comprising:

inserting a first plurality of pins in a first housing portion, the first housing portion having a plurality of slots on a top surface for holding the first plurality of pins, placing a first flexible circuit board over a portion of the first housing;

inserting a second plurality of pins and a third plurality of pins in a second housing portion, the second housing portion having a plurality of slots on a bottom surface for holding the second plurality of pins and a plurality of slots on a top surface for holding the third plurality of pins;

placing the second housing portion over the first housing portion, such that the first flexible circuit board is at least partially between the first housing portion and the second housing portion;

placing a second flexible circuit board over a portion of the second housing;

inserting a fourth plurality of pins in a third housing portion, the third housing portion having a plurality of slots on a bottom surface for holding the third plurality of pins, placing the third housing portion over the second housing portion, such that the second flexible circuit board is at least partially between the second housing portion and the third housing portion; and inserting a frame to mechanically support the first housing portion, the second housing portion, and the third housing portion.

13. The method of claim 12 wherein the first housing portion, the second housing portion, and the third housing portion are plastic and the frame is metallic.

14. The method of claim 12 wherein the first flexible circuit board comprises:

a center conductor having a top surface and a bottom surface;

a first insulating layer at least partially covering the top surface; and a second insulating layer at least partially covering the bottom surface.

15. A socket comprising:

a plurality of wafers, each wafer formed of a nonconductive material and arranged to hold one or more conductive pins, wherein each wafer includes an alignment mechanism such that each wafer aligns to a neighboring wafer; and a housing to at least partially enclose the plurality of wafers and having a first opening and a second opening, wherein the first opening is arranged to accept a first memory device and the second opening is arranged to accept a second memory device, wherein the conductive pins have a first end and a second end, where the first ends are arranged to mate with contacts on the first and second memory devices and the second ends are arranged in an array, and wherein a first plurality of the second ends attach to a first flexible circuit board.

16. The socket of claim 15 wherein second plurality of the second ends attach to a second flexible circuit board.

* * * * *